US009851112B2

(12) United States Patent
Jones

(10) Patent No.: US 9,851,112 B2
(45) Date of Patent: Dec. 26, 2017

(54) HVAC UNIT IDENTIFICATION DEVICE AND METHOD

(71) Applicant: Ray Jones, Havana, FL (US)

(72) Inventor: Ray Jones, Havana, FL (US)

( * ) Notice: Subject to any disclaimer, the term of this patent is extended or adjusted under 35 U.S.C. 154(b) by 0 days.

(21) Appl. No.: 15/046,602

(22) Filed: Feb. 18, 2016

(65) Prior Publication Data

US 2017/0241651 A1 Aug. 24, 2017

(51) Int. Cl.

| | |
|---|---|
| ***F24F 1/20*** | (2011.01) |
| ***G08B 3/02*** | (2006.01) |
| ***F24F 11/02*** | (2006.01) |

(52) U.S. Cl.

CPC ..... *F24F 1/20* (2013.01); *F24F 11/02* (2013.01); *G08B 3/02* (2013.01)

(58) Field of Classification Search

CPC .. F24F 1/20; F24F 11/02; F24F 11/006; F24F 11/0086; F24F 2011/0068; F24F 11/008; F24F 2011/0047; F24F 2011/0075; F24F 11/0012; G08C 19/18

See application file for complete search history.

(56) References Cited

U.S. PATENT DOCUMENTS

| | | | | |
|---|---|---|---|---|
| 6,089,310 A * | 7/2000 | Toth | F24F 11/0009 | 165/11.1 |
| 7,222,800 B2 * | 5/2007 | Wruck | C09D 5/4492 | 165/11.1 |
| 7,821,218 B2 * | 10/2010 | Butler | F04D 27/004 | 318/461 |
| 2009/0266092 A1 * | 10/2009 | Harrod | F25B 49/022 | 62/126 |

* cited by examiner

*Primary Examiner* — Kabir A Timory
(74) *Attorney, Agent, or Firm* — J. Wiley Horton

(57) ABSTRACT

A device for pulsing the control lines of an HVAC system in order for a user to discover which outside unit is associated with a particular inside unit. Lead wires from the device connect to the control contacts on the thermostat of an HVAC unit. The device is an electrical or electromechanical circuit that can use the power contained within the thermostat or can be battery powered. Once the device is connected, it pulses the control line for the reversing valve, in the case of a heat pump system, or pulses the control line for the compressor, for a cooling-only system. This pulsing creates a loud clicking sound in either case that allows the repair technician to decipher the correct outside unit corresponding to the inside unit without use of a helper.

20 Claims, 11 Drawing Sheets

HVAC UNIT IDENTIFICATION DEVICE AND METHOD

CROSS-REFERENCES TO RELATED APPLICATIONS

Not Applicable.

STATEMENT REGARDING FEDERALLY SPONSORED RESEARCH OR DEVELOPMENT

Not applicable

MICROFICHE APPENDIX

Not Applicable

BACKGROUND OF THE INVENTION

1. Field of the Invention

This invention relates to the field of heating, ventilation and air conditioning. More specifically, the invention comprises an electrical or electromechanical device that pulses the control line of an outdoor HVAC unit using the thermostat connections in order to indicate to a user which outdoor unit is associated with a particular indoor unit.

2. Description of Related Art

On most occasions heating, ventilation and air conditioning (HVAC) systems are set up with some components on the inside of a dwelling and some components on the outside. Such a system is often called a "split system." FIG. 1 shows an example of a prior art split system. Inside unit 12 is located inside dwelling 10 while outside unit 14 is located outside the dwelling. The user controls, along with some type of temperature sensing device, are most often located in thermostat 22. Thermostat 22 has control lines 20 that run to control circuit 18 located within inside unit 12. Additional control lines 20 run from control circuit 18 to outside unit 14. In addition to control lines, refrigerant lines 16 run between inside unit 12 and outside unit 14. These lines carry the working fluid that circulates within the HVAC system.

In the case of large apartment complexes, multiple outside HVAC units are often located behind the building or on the roof. The presence of multiple outdoor units can can make it difficult to determine which outside unit corresponds to a particular inside unit. This becomes an issue when air conditioning repair personnel need to access the outside unit, but are faced with a multitude of nearly identical units with no method for deducing which is the correct unit. This scenario is shown in FIG. 4. In the example of FIG. 4, there are multiple outside units 14 behind a group of apartments 24. While FIG. 4 shows only six apartments 24, this situation becomes increasingly complex with the addition of more apartments (possibly occupying multiple floors).

Control and refrigerant lines run from the inside units 12 in each apartment 24 to an associated outside unit 14. Due to the quantity of lines and the fact that portions of the lines may be concealed, it would be a complicated if not impossible task to follow the lines from the apartment to the correct outside unit. Therefore, another method is typically used. The current solution requires the repair technician to bring an additional helper along for the repair job. The helper is tasked with quickly switching the air conditioning unit on and off from the thermostat inside the apartment while the technician waits outside listening for which unit comes on. (The task of the technician and helper could easily be switched). In the case of an air conditioning unit with a heat pump, a typical method is to switch the unit from heating to cooling or vice-versa. This action actuates the reversing valve contained in the outside unit. The actuation of the reversing valve causes a loud click which may be easily head.

Those skilled in the art will know that the reversing valve in a heat pump outdoor unit directs the refrigerant to flow in a selected direction. In one direction the system is in cooling mode. In this mode the coils and fan inside the dwelling act as the evaporator and the outside coils act as the condenser, thus cooling the air inside the dwelling. When the valve is reversed to heating mode, the coils switch roles and the air inside the dwelling is heated.

Actuating the reversing valve, again located in the outside air conditioning unit, creates a distinct clicking sound which can be heard by a helper standing near the outside units. The helper may then identify which outdoor unit is associated with the thermostat that the other technician is manipulating. A cooling-only system does not have a reversing valve. In the case of a cooling-only unit, briefly switching the air conditioning unit on activates the start contactor for the compressor. This also generates a loud clicking sound. The outside helper is then able to correctly identify the outside unit by listening for this clicking sound. Developing a method to identity the correct outside unit without the need for a second technician on-site would reduce the cost of HVAC repair work in multi-unit situations. A device that does this automatically would allow only one technician to go out to a site, thus leaving the second technician available for another job and only paying one technician for a job that now only requires one person. It is also important that the device used to actuate the reversing valve be compatible with most air conditioning units. The proposed invention allows a single technician to identify the outside unit and is compatible with both heat pump and cooling-only systems.

BRIEF SUMMARY OF THE PRESENT INVENTION

The present invention comprises a simple electrical device that pulses a signal on a control line of an HVAC unit in order to allow the identification of an outside unit corresponding to a particular inside unit. The inventive device typically connects to the control lines at the thermostat. In the case of a heat pump system, the device pulses the control line connected to the reversing valve. This action briefly energizes the valve, thus switching it from heating to cooling mode, repeatedly. The device does not energize any other part of the system, it only switches the valve. The result of this pulsing of the reversing valve is a loud clicking noise. The repair technician leaves the device attached to the thermostat, and it continues to pulse. As the device pulses, this continuous clicking sound can be heard by the air conditioning repair technician when he or she walks outside to listen. The device hereby allows the technician to determine which outside unit is associated with the inside unit connected to the device inside the dwelling.

In the case of an HVAC system having only cooling capabilities, the inventive device pulses the control line of the start contactor for the compressor. This pulsing is quick enough so that the motor of the compressor is not engaged, but the start contactor does create a clicking sound, similar to the clicking heard from the reversing valve, when it is energized. The repair technician then listens outside for the clicking sound to determine the corresponding outside unit, as done with the heat pump unit.

The device connects to the existing wires contained in the thermostat of the air conditioning unit. This method allows the repair technician to connect the device to almost any air conditioning unit that he or she may encounter on the job. The device is preferably able to operate from the power contained in the thermostat or from power supplied by battery.

In addition to the previously stated attributes, the device comprises a circuit test function that tests for short circuits in the wires contained in the thermostat. The circuit has a breaker that trips with less current than the threshold of current of the breaker contained in the unit. By attaching the wires of the thermostat to wires of the circuit test (with the thermostat switched to off), the repair technician can determine whether there is a short in the circuit.

REFERENCE NUMERALS IN THE DRAWINGS

Figure 1:
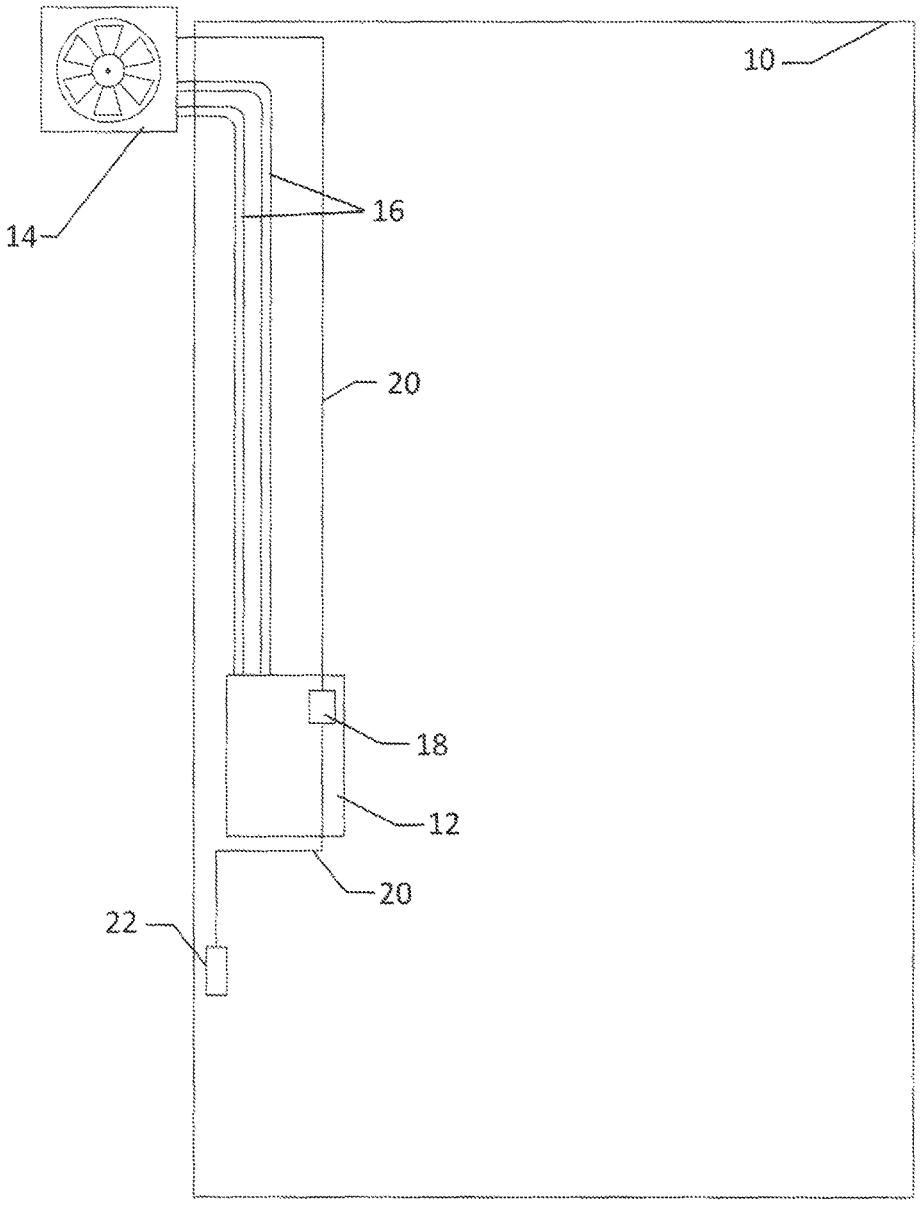
FIG. 1 (PRIOR ART)
FIG. 1 is a plan view, showing a typical setup of a prior art split HVAC system.

| | | | |
|---|---|---|---|
| 10 | dwelling | 12 | inside unit |
| 14 | outside unit | 16 | refrigerant lines |
| 18 | control circuit | 20 | control lines |
| 22 | thermostat | 24 | apartment |
| 26 | compressor | 28 | reversing valve |
| 30 | outside coil | 32 | outside fan |
| 34 | expansion valve | 36 | inside coil |
| 38 | inside fan | 40 | pulse generator |
| 42 | battery | 44 | time-delayed relay |
| 48 | thermostat power | 50 | reversing valve control |
| 52 | solenoid | 54 | compressor control |
| 56 | start contactor | 58 | fan control |
| 60 | system control | 62 | connection wires |
| 64 | thermostat contacts | 66 | heating contact |
| 68 | common contact | 70 | 24 VAC contact |
| 72 | fan contact | 74 | cooling contact |

-continued

REFERENCE NUMERALS IN THE DRAWINGS

| | | | |
|---|---|---|---|
| 76 | heating control line | 78 | common line |
| 80 | 24 VAC line | 82 | fan line |
| 84 | cooling line | 86 | emergency heat contact |
| 88 | reversing valve contact | 90 | emergency heat line |
| 92 | reversing valve line | 94 | relay |
| 96 | relay coil | 97 | relay coil |
| 98 | relay coil contacts | 100 | spring |
| 102 | common contact | 104 | normally open contact |
| 106 | normally closed contact | 108 | armature |
| 110 | alligator clip | | |

DETAILED DESCRIPTION OF THE INVENTION

The present invention uses an electrical or electromechanical device, such as a time delayed relay driven by a fixed voltage, to pulse the control lines of an HVAC unit. The pulse generating device may be referred to as a "pulse generator." FIG. 1 shows a schematic of a prior art split HVAC system in a dwelling 10. This is a typical setup for an HVAC system found in a home or apartment. The split system has an inside unit 12 and an outside unit 14 that may sit behind or on top of the dwelling 10.

The preferred embodiment of the present invention is attached to the thermostat 22. It pulses the control lines 20. These lines lead to control circuit 18 contained within inside unit 12. Control lines 20 then run from inside dwelling 10 to outside unit 14, activating the correct mechanism as described in the succeeding text.

Figure 2:
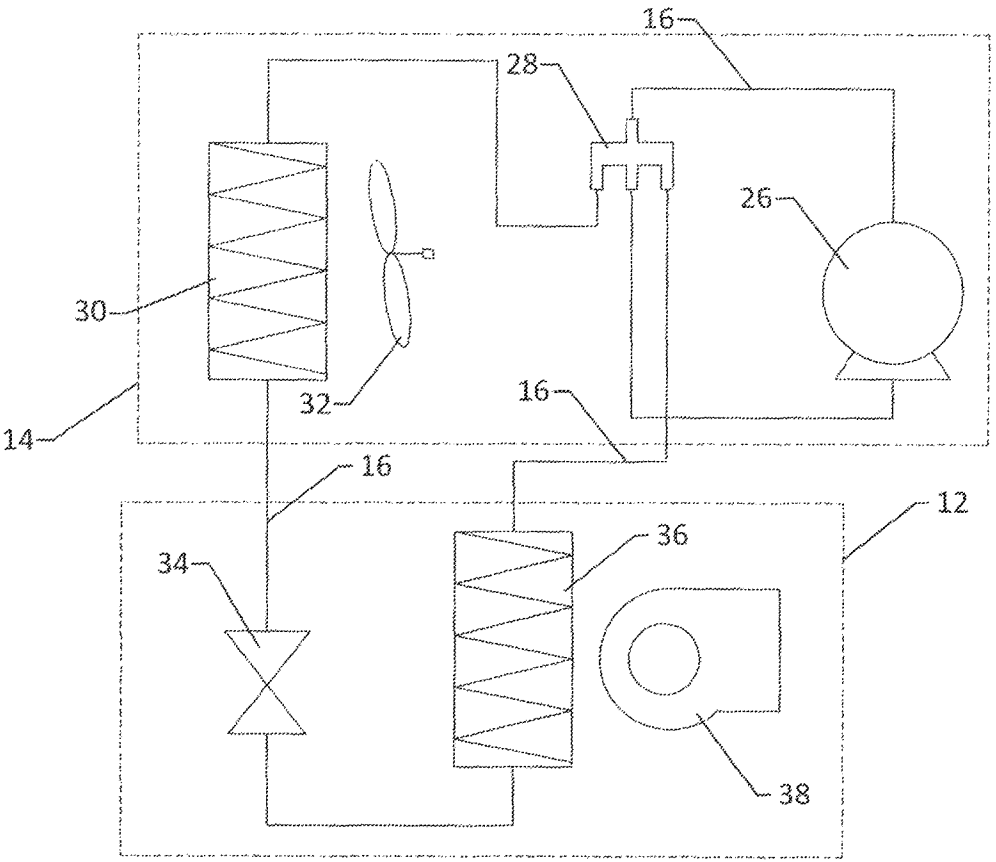
FIG. 2 (PRIOR ART)
FIG. 2 is a schematic view, showing a prior art split HVAC system using a heat pump cycle.

For the case of a heat pump HVAC system, the inventive device pulses the control line for the reversing valve. FIG. 2 shows a schematic of the refrigeration cycle of a heat pump that contains indoor unit 12 and outdoor unit 14. This is a split system where refrigerant lines 16 run between the two units. As indicated by FIG. 2, the outdoor unit 14 contains compressor 26, reversing valve 28, outside coil 30 and outside fan 32. There are refrigerant lines 16 running throughout the system, which transport refrigerant (in different states of matter) to the necessary components of the system.

This transportation is made possible by compressor 26, the heart of the cycle. It pressurizes the refrigerant, pumping it into the outside or inside coil (depending on whether the system is in heating or cooling mode). The pressurized refrigerant leaves the compressor 26 through the refrigerant line 16 connecting the compressor to reversing valve 28. As mentioned in the preceding text, reversing valve 28 allows one HVAC system to both heat and cool the dwelling rather than requiring two separate systems. Depending on what mode the system is in (heating or cooling), outside coil 30 receives refrigerant from reversing valve 28 or sends it. Outdoor fan 32 moves air over outside coil 30. Indoor fan 38 moves air over indoor coil 36.

Reversing valve 28 is commonly in an energized state during the cooling cycle (the energized state could just as easily be the heating cycle). In this state the pressurized refrigerant runs from compressor 26, through reversing valve 28, to outdoor coil 30 (which acts as a condenser), through expansion valve 34, and then to indoor coil 36. After passing through indoor coil 36 the gaseous refrigerant flows back through another portion of reversing valve 28 and then to the suction side of compressor 26.

Reversing valve 28 is in a de-energized state during the heating cycle. In that state the pressurized refrigerant runs from compressor 26, through the reversing valve to indoor coil 36. The indoor coil operates as a condenser. The refrigerant then flows from indoor coil 36 through expansion valve 34 and then to outdoor coil 30 (which acts as a evaporator).

The indoor fan 38 forces air across the indoor coil 36, which circulates the air through the dwelling to provide heating or cooling. The outdoor fan 32 forces ambient air over outdoor coil 30 to cool the outdoor coil (in air conditioning mode) or heat the outdoor coil (in heating mode).

Figure 3:
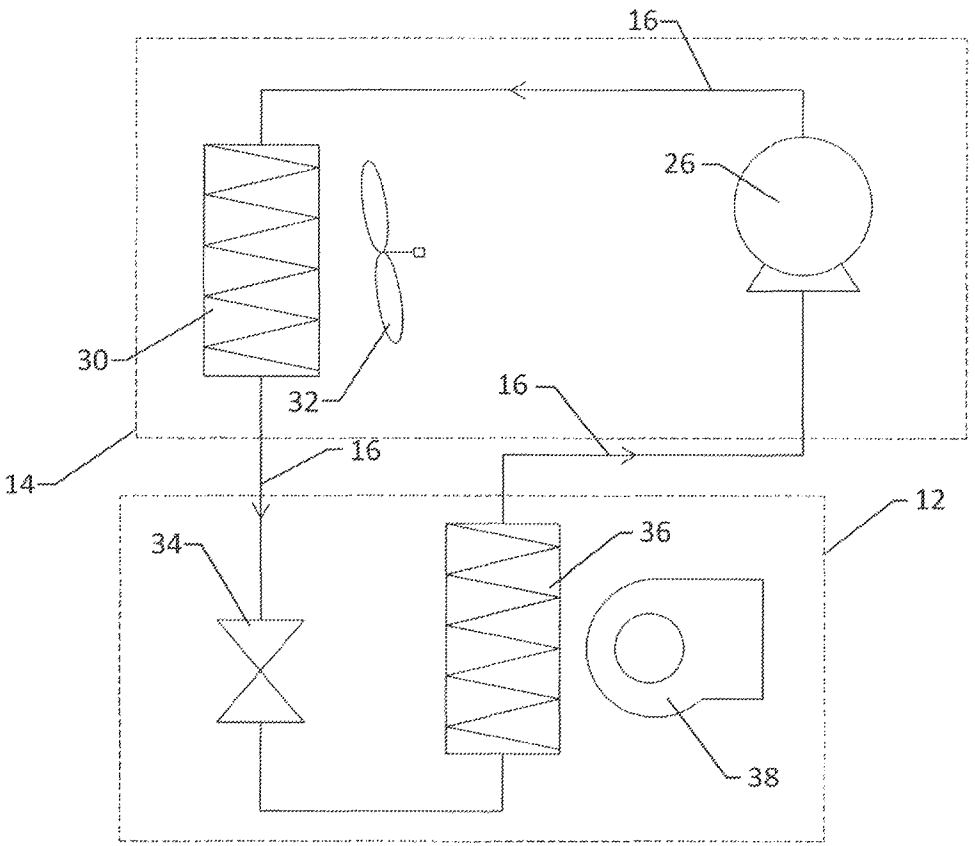
FIG. 3 (PRIOR ART)
FIG. 3 is a schematic view, showing a prior art split HVAC system using a standard refrigeration cycle used for cooling-only.

FIG. 3 shows a schematic of a prior art split HVAC system that only cools. The system is similar to that seen in FIG. 2, except reversing valve 28 is absent and the refrigerant only circulates in one direction. The refrigerant line 16 coming from the inside coil 36 travels directly to the compressor 26, and the refrigerant line 16 coming from the compressor 26 runs directly to the outside coil 30. The system in FIG. 3 does not allow for reversal. It can only work in cooling mode. The arrows on refrigerant lines 16 indicate the direction of refrigerant flow, where (as discussed in the preceding text) outside coil 30 always acts as the condenser and indoor coil 36 always acts as the evaporator. Units that only act as cooling systems may have electrical heating coils, a separate system for heating, such as a furnace or radiator, or may not need to be heated.

Figure 4:
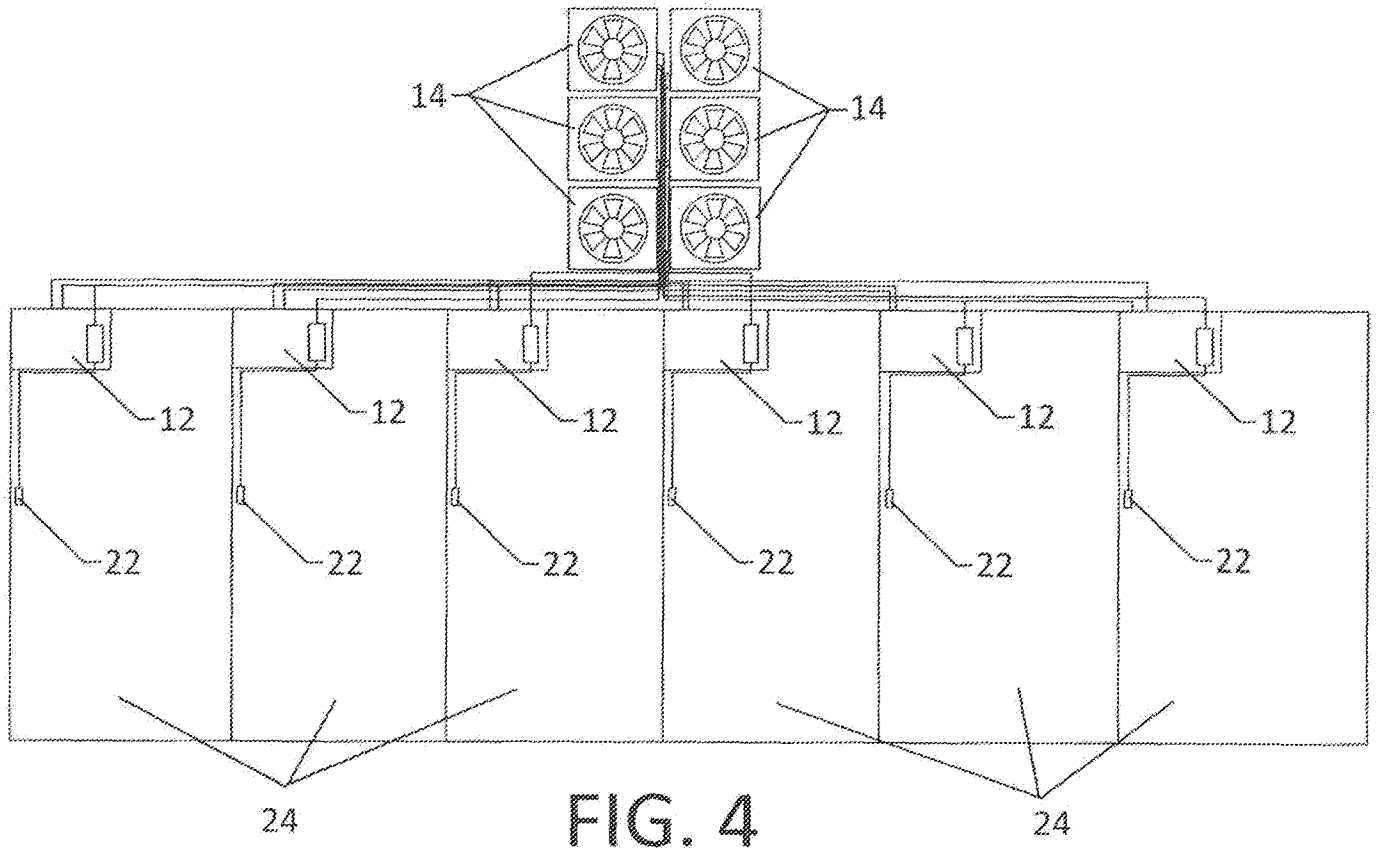
FIG. 4 (PRIOR ART)
FIG. 4 is a plan view, showing multiple apartments and the correspond ins split HVAC systems.

In a heat pump unit, when the reversing valve line is energized, the valve creates a clicking sound. This sound is generated by the solenoid used to actuate the reversing valve. A solenoid is an electromagnetic device used to adjust the position of the reversing valve when necessary. The clicking sound created is the sound of the activation the solenoid that adjusts the valve. Briefly and repeatedly pulsing the control line thus creates a continuous clicking sound that is audible to a person nearby. FIG. 4 shows a prior art schematic of multiple apartments 24 with the corresponding outside A/C units 14 located behind the apartments 24. When the current invention is connected to thermostat 22 inside a particular apartment 24, the line leading to the reversing valve is quickly and repeatedly switched on and off. The technician leaves the invention inside and walks outside to listen for the clicking sound. This allows him to identify the outside unit corresponding to the particular apartment where the invention was connected to the thermostat.

In the case of an air conditioning unit that is not a heat pump, the unit can only cool. This type of HVAC system does not contain a reversing so the outside coil always acts as a condenser and the inside coil always acts as an evaporator, as discussed in the preceding text. This situation does not allow the current invention to pulse the line for the reversing since there is not a reversing valve present. However, a large electromechanical start contactor is typically used to start the compressor.

A start contactor is a large electromechanical device that acts as a converter in an HVAC system. A 24 VAC signal is sent from the thermostat to the start contactor. Once the start contactor is energized with the 24 VAC signal, the contacts are closed and a 240 VAC circuit is completed. The 240 VAC signal is used to power the compressor. This device allows the use of a relatively low 24 VAC control signal to govern a 240 VAC power signal Similar to the reversing valve, the start contactor also creates a clicking sound when the control line for the compressor is activated. By rapidly and periodically pulsing the cooling line on a straight cooling unit, the start contactor generates a continuous clicking sound, thereby realizing the same effect as that observed using the reversing valve in the heat pump system. The start contactor is only energized for a brief interval—too short a time to actually start the compressor spinning.

Figure 5:
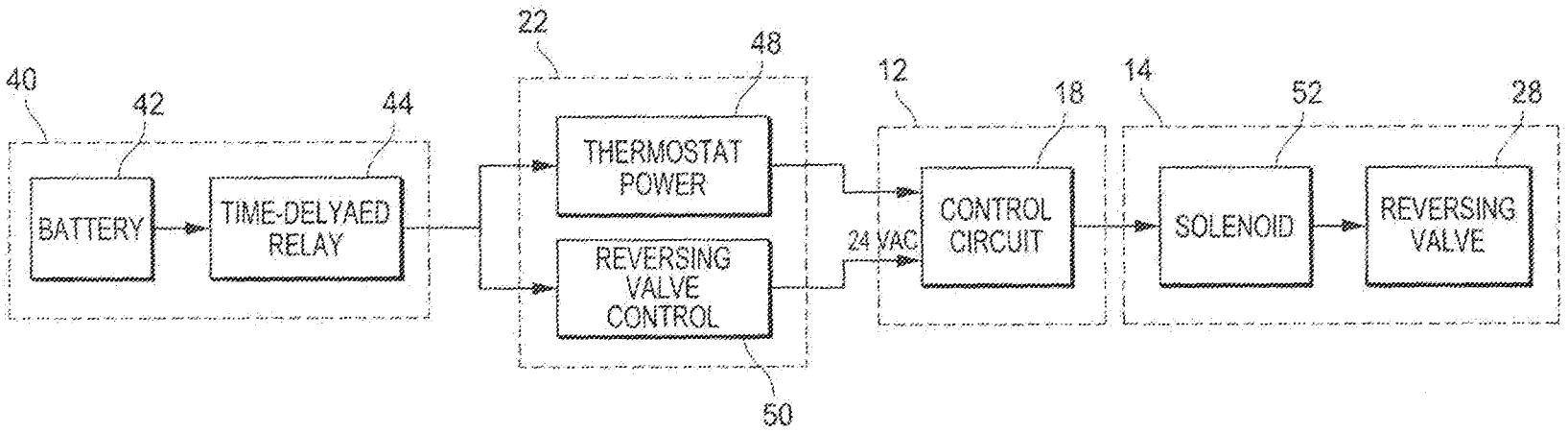
FIG. 5 is a schematic view, showing a block diagram that indicates the operation and key elements needed for the current invention when connected to a heat pump system (battery-powered embodiment).

A sequential block diagram showing the operation of an embodiment of the inventive device is shown in FIG. 5. The diagram in FIG. 5 may refer to a heat pump or an HVAC system that is cooling-only. In this embodiment, power is supplied to the pulsing circuit by a battery. However, the method of powering the invention has no bearing on the HVAC system for which it is being used and a variety of different power sources could be employed.

The pulse generator 40, indicated in the block diagram, represents an embodiment that uses battery 42 to power time delayed relay 44 (or similar electrical circuit capable of creating a pulsed voltage). The electrical leads from the pulse generator 40 connect to the contacts for thermostat power 48 and reversing valve control 50 on thermostat 22. The pulsing device contained in pulse generator 40 periodically connects power to reversing valve control 50 (It applies a voltage to the reversing valve control line). When connected, the 24 VAC signal travels to control circuit 18 located within inside unit 12. That signal is then transmitted to solenoid 52 of reversing valve 28, which is located in outside unit 14. The rapid and periodic signal quickly energizes solenoid 52 and actuates reversing valve 28. With this actuation, a clicking sound is heard from outside unit 14, allowing the repair technician to locate the correct unit.

Another embodiment of the current invention allows for the device to be operated using power available on the thermostat itself rather than an external power source such as a battery. In this embodiment, the pulse generator has additional electrical lead wires connected to the pulsing circuit in order to provide power. The connection is preferably made using a temporary device such as such as alligator clips or the like (discussed further in the succeeding text).

Figure 6:
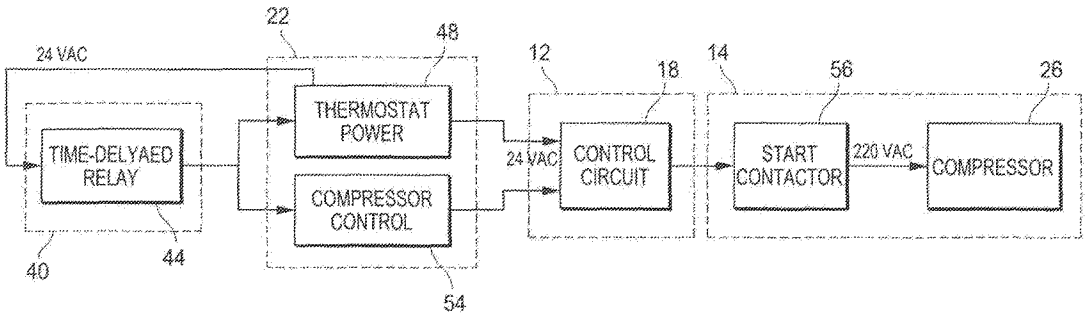
FIG. 6 is a schematic view, showing a block diagram that indicates the operation and key elements needed for the current invention when connected to a cooling-only system (thermostat-powered embodiment).

FIG. 6 shows a sequential block diagram, illustrating the operation of another embodiment of the pulse generator when connected to a straight air conditioning unit. This figure shows the current embodiment connected to a cooling-only air conditioning system to exemplify the difference between how the device works with a heat pump system versus cooling-only HVAC system. In addition, this embodiment of pulse generator 40 is powered by thermostat power 48 (24 VAC) rather than an external battery. The thermostat power is connected to time delayed relay 44 (or similar electrical circuit capable of producing a pulsed output). While the invention is shown connected to a cooling-only air conditioning system, this is not to suggest that the externally-powered embodiment of the invention can only operate on a cooling-only system. This differentiation is simply to illustrate two separate embodiments of the invention (battery powered and thermostat powered). Either embodiment can be used on any type of HVAC system but in an attempt to reduce redundancy the battery powered device is shown connected to a heat pump system and the thermostat powered device is shown connected to a cooling-only system. The two devices could have easily been switched so that the thermostat powered invention was on the heat pump system and the battery powered device was on the cooling-only system.

Similar to the description in FIG. 5, the embodiment shown in FIG. 6 quickly and periodically pulses the control lines contained in thermostat 22. However, the electrical leads of pulse generator 40 connect to different thermostat contacts than those in FIG. 5. In the case of the straight air conditioning system, thermostat power 48 and compressor control 54 are the two contacts activated. As discussed previously, cooling-only units do not have a reversing valve.

Consequently the invention must connect to the compressor control line. When the invention briefly and periodically connects the power to the compressor control line, the 24 VAC signal is sent to circuit control 18 located within inside unit 12. Control circuit 18 directs the signal to outside unit 14. The signal from pulse generator 40 energizes start contactor 56 for compressor 26. Once start contactor 56 is energized, the plunger contained within the start contactor is pulled to complete the 240 VAC circuit to power compressor 26. Start contactor 56 is only energized long enough to close the plunger, which creates the necessary clicking sound. It does not stay energized long enough to initiate rotation of the motor in the compressor 26. Thus, the invention does not waste energy.

FIGS. 5 and 6 demonstrate the versatility of the current invention and the fact that it can be used on different types of HVAC systems. In addition, these figures demonstrate two methods for powering the device, either by battery or thermostat power. As those familiar with the art know, connecting an electrical circuit either to a battery or to the power line for the thermostat is a relatively simple task. The electrical or electromechanical circuit used to pulse the line described here is that of a time-delayed relay. However, this should not be taken as limiting the scope of the invention; it should be viewed as one possible embodiment used to describe a specific method for carrying out the current invention.

Figure 7:
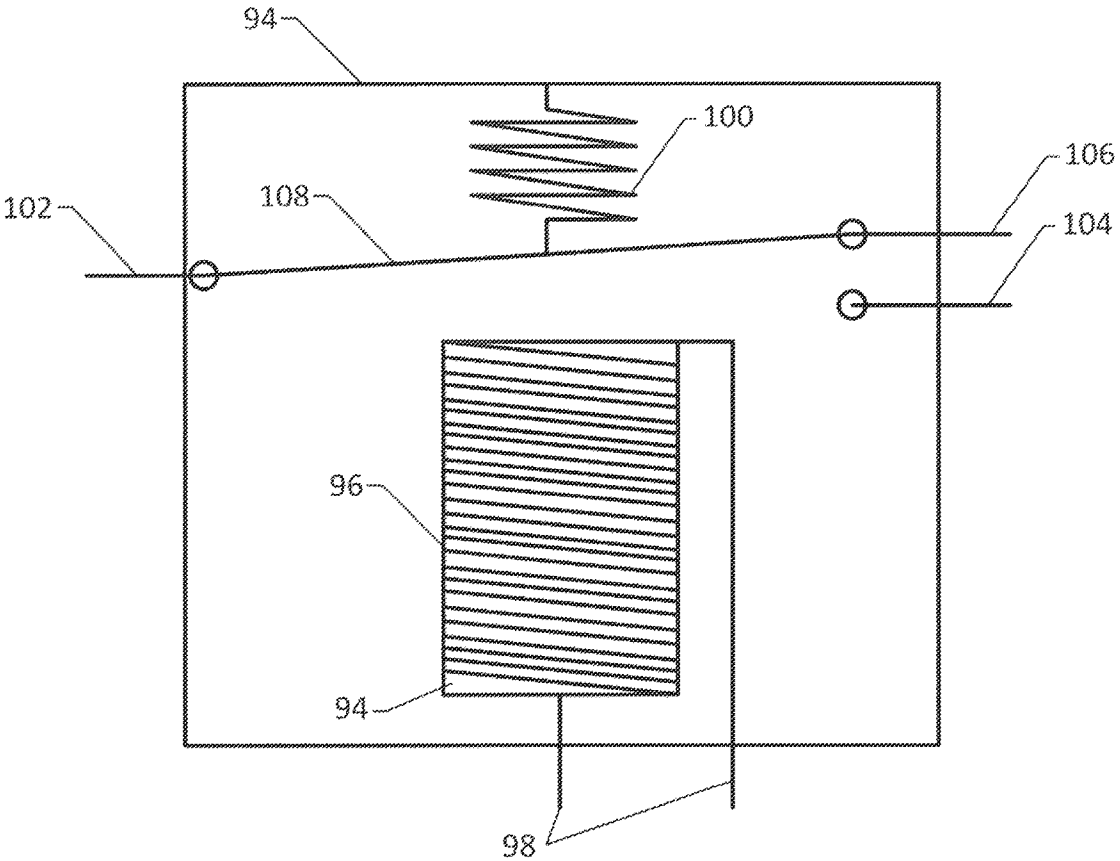
FIG. 7 (PRIOR ART)
FIG. 7 is a schematic view, showing the components of a prior art relay, such as may be used in the present invention.

There are many, many different ways to create a circuit that generates a suitable pulsed voltage. One approach is to use a simple electromechanical relay. FIG. 7 shows a prior art schematic of a relay switch 94. The simplified illustration demonstrates a preferred embodiment of the current invention. Those familiar with the art will recognize that once a power source, such as power from the thermostat or a battery as described in the preceding text, is connected to coil contacts 98, a magnetic field is generated. This magnetic field is created by the interaction of core 97 with coil 96 wrapped around the core. When coil 96 is not energized, spring 100 holds armature 108 in the position shown in FIG. 7. This position has armature 108 on the normally closed contact 106. Once coil 98 is energized, the magnetic field produced attracts armature 108 downward with respect to the view shown in FIG. 7, thus connecting with the normally open contact 104. In the case of the current invention, connecting to normally open contact 104 and common contact 102 would result in the circuit completing upon energizing the coil contacts using either a battery or the thermostat power.

The preceding text regarding FIG. 7 demonstrates the simplicity of a relay switch. A relay switch is suggested in the text because it is a simple, readily-available and inexpensive component for the current invention. This is especially true in the case of a time-delayed relay, where the timing and switching components are contained in a single unit. The convenience and simplicity of a relay switch make a good fit for the current invention. Although it is a convenient option, a relay switch is not the only option for the pulsing portion of the invention.

As those familiar with the art will recall, a time-delayed relay can be set to cycle on and off. Connecting power to a relay switch, such as that found in FIG. 7, that has a timing component allows the device to quickly alternate between the normally open and normally closed contacts. In the case of the air conditioning system and current invention, the time-delay can be set so that the connection is only made for a very short amount of time. This enables only enough time to power the start contactor or reversing valve so the compressor motor or other components of the system do not power on. This is a significant component of the device, which will save the consumer to energy costs.

An example of a device that can control the timing aspect of the relay is a 555 timer. As those familiar with the art know, a 555 timer is an integrated circuit that comprises transistors, diodes and resistors. A 555 timer uses resistance and capacitance to bring a timing aspect to the circuit. The time constant of the RC circuit determines the pulse width coining from the timer. In order to adjust the timing and duration of the pulse, the resistance and capacitance of the resistors and capacitors in the system are changed.

A 555 timer has three modes, which include monostable, astable, and bistable. Monostable mode allows a single pulse to issue from the device, and bistable mode acts as a flip-flop circuit, which can be made to change states. The mode to be considered for the current purpose is the astable mode. This mode allows for continual pulsing, which is desired in this application. The frequency of the output (rectangular pulses) from the timer is determined by the resistance of the resistors and capacitance of the capacitor. Once these values are set, the device can pulse a relay switch (or many other devices) as desired in order to be used in the invention.

Figure 8:
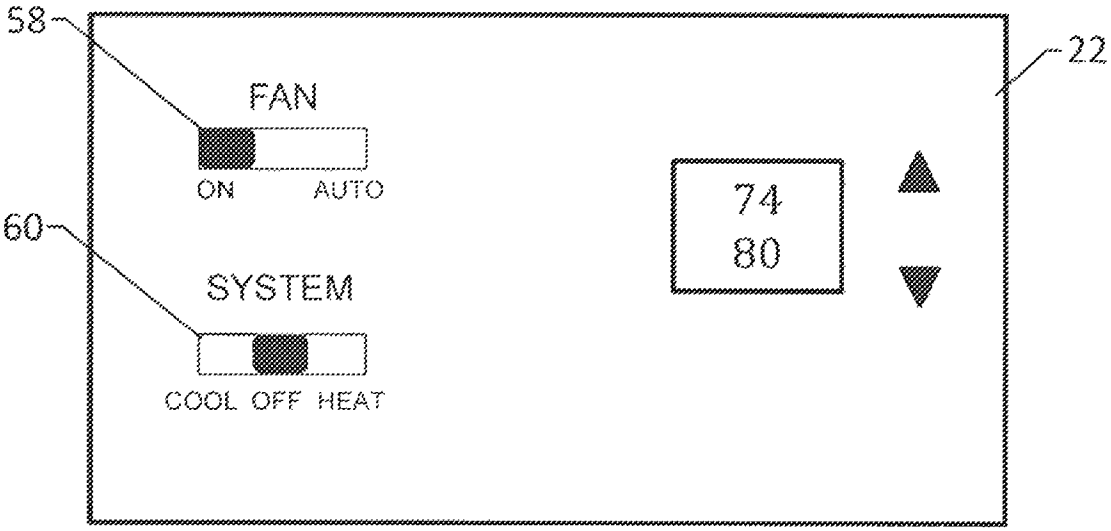
FIG. 8 (PRIOR ART)
FIG. 8 is an elevation view, showing the front face of a thermostat typical of a split HVAC system.

FIG. 8 shows the front face of a prior art thermostat. Thermostat 22 has fan control 58 and system control 60. With FIG. 8 in mind, the reader should consider FIG. 9. It shows a schematic of a typical wiring configuration for a thermostat that is a cooling-only air conditioning unit. There are five thermostat contacts 64 on thermostat 22. From left to right, the contacts are heating 66, common 68, 24 VAC (live) 70, fan 72 and cooling 74. As shown, the contacts are commonly represented by the letters (in the same order as above) W, C, R, G and Y, respectively. These letters represent the common labeling in a typical HVAC unit, and may or may not refer to the color of the wire. These contacts have a corresponding contact on the control circuit 18, located in the inside unit. Heating control line 76, common line 68, 24 VAC line 80, fan control line 82 and cooling control line 84 run from the thermostat to said control circuit 18. For use with such a cooling-only system, the present invention connects to cooling contact 74 (the Y contact), in order to send a signal to the compressor's start contactor.

Figure 9:
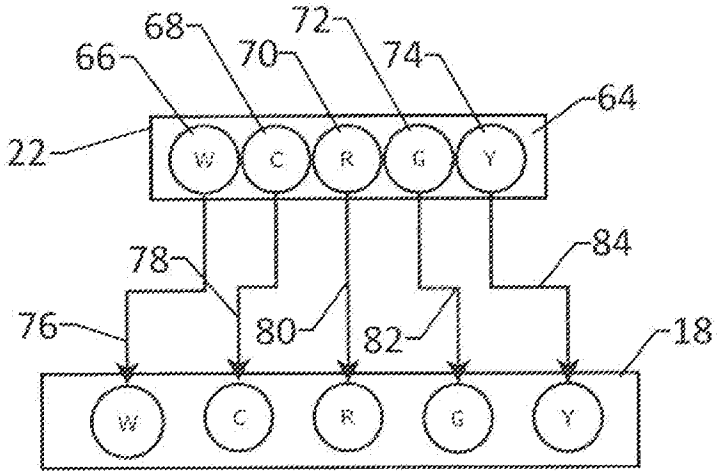
FIG. 9 (PRIOR ART)
FIG. 9 schematic view, showing the wiring and contacts located on the thermostat and control circuit of a cooling-only HVAC unit.

The following serves to give the reader a better understanding of the relationship between the settings contained in thermostat 22 in FIG. 8 and the wiring in FIG. 9. If the system control 60 and the fan control 58 in FIG. 8 are set to "COOL" and "ON", respectively, the wires in FIG. 9 that are activated are 24 VAC 80, fan 82 and cooling 74. The cooling control line 84 runs to control circuit 18, then to the outside unit. As was discussed in the preceding text, cooling control line 84 then activates the start contactor for the compressor to start the refrigeration cycle. The fan control line 72 activates the indoor fan, which forces air over the cooling coils in order to cool the dwelling. Another example of the relationship between the thermostat settings in FIG. 8 and the wiring in FIG. 9 is the configuration that the thermostat in FIG. 8 is currently set to. The system control 60 is set to "OFF" while the fan control system 58 is set to "ON". This disposition correlates to 24 VAC line 80 and fan control line 82 being activated. This corresponds to the fan running without any refrigeration cycle or cooling.

Figure 10:
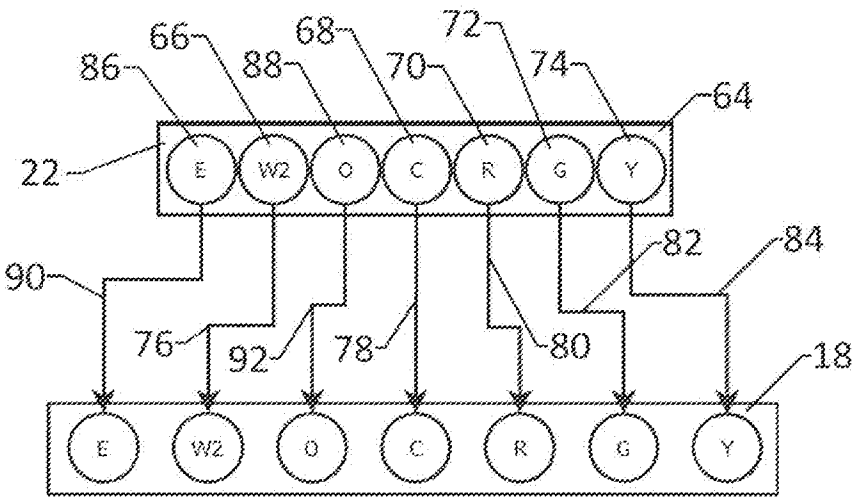
FIG. 10 (PRIOR ART)
FIG. 10 is a schematic view, showing the wiring and contacts located on the thermostat and control circuit of a heat pump HVAC unit.

Similarly, FIG. 10 shows the contacts on a thermostat 22 and control circuit 18; however, this represents contacts for heat pump air conditioning system. As FIG. 10 indicates, there are more contacts for a heat pump system than a cooling-only system. An emergency heat contact 86 and reversing valve contact 88 are present on thermostat 22 as well as all the contacts found in FIG. 9. Also, some of the contact labels typical for a heat pump system are different. The different and added contact labels are as follows, emergency heat contact 86 is E, heating contact 66 is W2, and reversing valve contact 88 is O.

The important addition is reversing valve contact 88, or the O contact. This is the contact the present invention connects to for a heat pump HVAC system. The reversing valve is energized when the system is in cooling mode. So when thermostat 22 in FIG. 8 has fan control 58 set to "ON" (or "AUTO") and system control 60 set to "COOL", the control line, in FIG. 10 activated are the reversing valve control line 92, fan control line 82 and cooling control line 84. The reversing valve is normally in heating mode when not energized (by default) so if the system control 60 in FIG. 8 is switched to heat, the control lines activated are heating 76 and fan 82. These configurations are well known to those familiar with the art.

Figure 11:
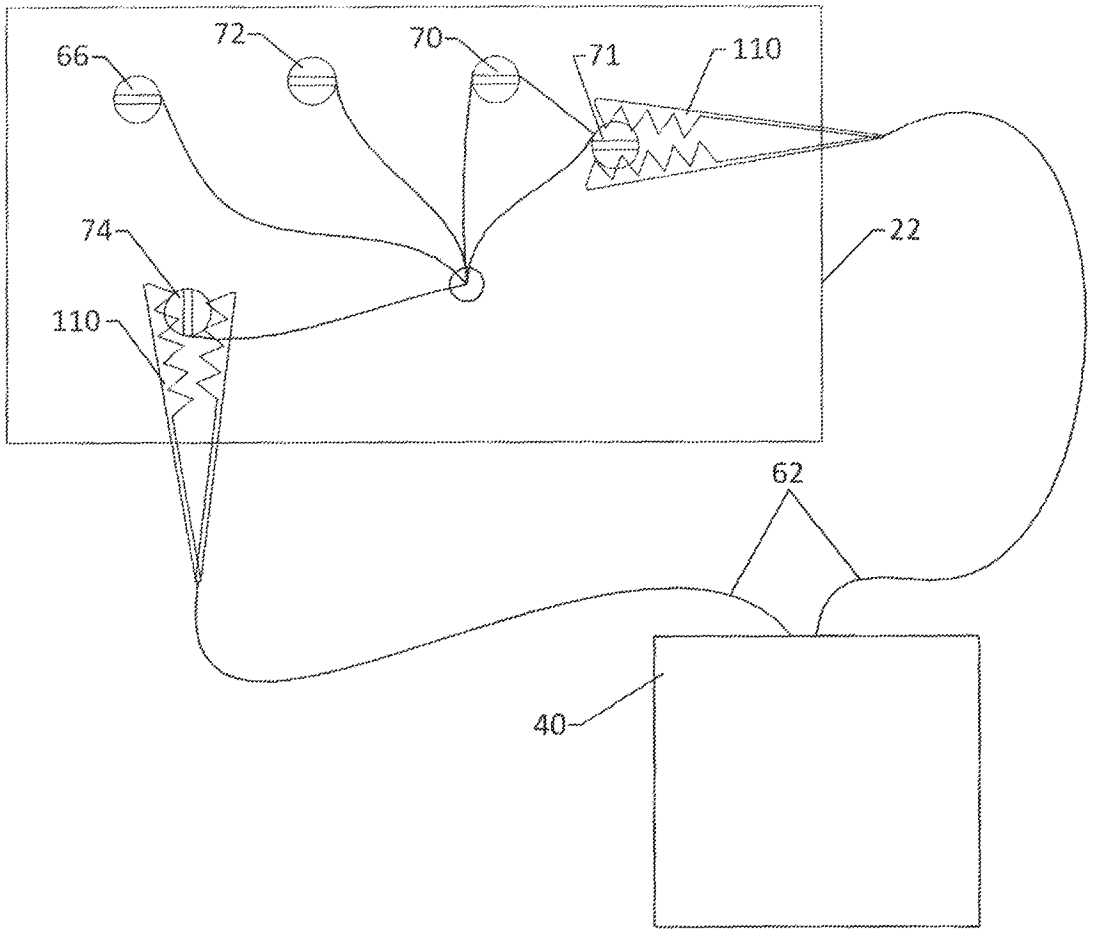
FIG. 11 is an elevation view, showing a thermostat with the front cover removed and an embodiment of the current invention connected to the thermostat contacts.

FIG. 11 shows a diagram of thermostat 22 with the cover removed. This diagram is that of a thermostat for a cooling-only HVAC system. By comparing the contacts from FIG. 9 to those in FIG. 11, the reader will observe that there is an extra contact in FIG. 11. The cooling 24 VAC power contact 71 is represented on thermostat 22 by RC. Usually, cooling power 71 is connected to 24 VAC contact 70, or the R contact, by means of a jumper wire (for a cooling-only system). While this is not shown in FIG. 9 for the sake of simplicity, it is necessary and helpful to show in FIG. 11.

There are numerous mechanisms that can be employed to attach the current invention to a thermostat. FIG. 11 shows one such method. Thermostat 22 has the front cover removed exposing the contacts for the controls. A schematic of the front face of a prior art thermostat is shown in FIG. 8, and is discussed in the preceding text. Current invention 40 contains lead wires 62 attached to alligator clips 110. Thermostat 22 shown in FIG. 11 corresponds to an air conditioning unit that cools only, as stated hove. Alligator clips 110 are attached to cooling control contact 74 (Y) and cooling power contact 71 (RC). Upon energizing the pulsing circuit in pulse generator 40, the circuit running through the A/C system is completed by means of alligator clips 110 and lead lines 62 connected to the cooling contact 74 and 24 VAC cooling contact 71. Completion of said circuit results in energizing the start contactor, creating the clicking sound that is audible to someone near the outside unit.

In addition, a preferred embodiment of the invention comprises a method of testing for a short circuit within the thermostat. This circuit test function detects a short circuit in one of the thermostat control lines that run to the control circuit on the inside unit. It tests each line individually, which accounts for an air conditioning unit with a thermostat with any amount of control lines.

A typical unit has a breaker in the thermostat rated for 3-5 amps. Alternatively, the test function component of the current invention contains an internal breaker with a lower current rating. With the thermostat set to off, the device is attached to the thermostat contacts. Once the device is attached, the tripping of the breaker indicates that there is a short circuit.

The combination of a pulsing circuit for the application described previously and short circuit test operation is convenient for a repair technician. Both functions are implemented on the thermostat and connect electrically. Thus, it is convenient and cost-effective to use a device that is already connected to the thermostat to inspect the system for short circuits.

A specific description of the device has been established. Many other embodiments and applications are possible. For example, although heat-pump and AC-only systems have been discussed, the engine could also be applied to a heat-only refrigerant circulation system. The function, method of operation and preferred embodiment has been set forth, but the invention should be understood in the broad sense, as stated by the following claims rather than by any particular example given.

Having described my invention, I claim:

1. A method for determining in an installation having multiple HVAC systems, each of said systems including an inside HVAC unit, an outside HVAC unit, and a thermostat having a control wire controlling either a reversing valve or a compressor start contactor in said outside HVAC unit, which outside HVAC unit is connected to a selected inside HVAC unit, comprising:

a. providing is pulse generator, said pulse generator producing a pulsed output signal;

b. selecting a particular thermostat associated with a particular inside HVAC unit;

c. connecting said pulse generator to said control wire of said selected thermostat so that said pulsed output signal is applied to said control wire;

d. while said pulse generator remains attached to said control wire, listening for a noise produced by a cycling of said reversing valve or said compressor start contactor in said outside HVAC unit in order to determine such outside HVAC unit is connected to said selected thermostat.

2. The method for determining which outside HVAC unit is connected to a selected inside HVAC unit as recited in claim 1, wherein power for said electrical pulse generator is provided by a battery.

3. The method for determining which outside HVAC unit is connected to a selected inside HVAC unit as recited in claim 1, wherein power for said electrical pulse generator is provided by said selected thermostat.

4. The method for determining which outside HVAC unit is connected to a selected inside HVAC unit as recited in claim 3, wherein power for said electrical pulse generator is provided by connecting said electrical pulse generator to a 24 VAC line on said selected thermostat.

5. The method for determining which outside HVAC unit is connected to a selected inside HVAC unit as recited in claim 1, wherein said pulsed signal created in said electrical pulse generator using an electromechanical relay.

6. The method for determining which outside HVAC unit is connected to a selected inside HVAC unit as recited in claim 1, wherein said pulsed signal is created in said electrical pulse generator using an integrated circuit including a timer function.

7. The method for determining which outside HVAC unit is connected to a selected inside HVAC unit as recited in claim 2, wherein said pulsed signal is created in said electrical pulse generator using an electromechanical relay.

8. The method for determining which outside HVAC unit is connected to a selected inside HVAC unit as recited in claim 2, wherein said pulsed signal is created in said electrical pulse generator using an integrated circuit including a timer function.

9. The method for determining which outside HVAC unit is connected to a selected inside HVAC unit as recited in claim 3, wherein said pulsed signal is created in said electrical pulse generator using an electromechanical relay.

10. The method for determining which outside HVAC unit is connected to a selected inside HVAC unit as recited in claim 3, wherein said pulsed signal is created in said electrical pulse generator using an integrated circuit including a timer function.

11. A method for determining which outside HVAC unit is associated with a selected inside HVAC unit in an installation having multiple outside units and multiple inside units, comprising:

a. providing a plurality of split HVAC systems, wherein each HVAC system includes,
   i. an inside HVAC unit,
   ii. a thermostat connected to said inside HVAC unit,
   iii. an outside HVAC unit, connected to said thermostat by at least one control wire, said control wire controlling either a reversing valve or a compressor start contactor in said outside HVAC unit;

b. providing an electrical pulse generator, said pulse generator producing a pulsed output signal;

c. selecting a particular thermostat;

d. connecting said electrical pulse generator to said control wire connecting said selected thermostat to said outside HVAC unit connected to said selected thermostat;

e. activating said electrical pulse generator in order to place a pulsed signal on said control wire; and f. while said pulse generator remains attached to said control wire, listening for a noise produced by a cycling of said reversing valve or said compressor start contactor in said outside HVAC unit in order to determine which outside unit is connected to said selected thermostat.

12. The method for determining which outside HVAC unit is connected to a selected inside HVAC unit as recited in claim 11, wherein power for said electrical pulse generator is provided by a battery.

13. The method for determining which outside HVAC unit is connected to a selected inside HVAC unit as recited in claim 11, wherein power for said electrical pulse generator is provided by said selected thermostat.

14. The method for determining which outside HVAC unit is connected to a selected inside HVAC unit as recited in claim 13, wherein power for said electrical pulse generator is provided by connecting said electrical pulse generator to a 24 VAC line on said selected thermostat.

15. The method for determining which outside HVAC unit is connected to a selected inside HVAC unit as recited in claim 11, wherein said pulsed signal is created in said electrical pulse generator using an electromechanical relay.

16. The method for determining which outside HVAC unit is connected to a selected inside HVAC unit as recited in claim 11, wherein said pulsed signal is created in said electrical pulse generator using an integrated circuit including a timer function.

17. The method for determining which aside HVAC unit is connected to a selected inside HVAC unit as recited in claim 12, wherein said pulsed signal is created in said electrical pulse generator using electromechanical relay.

18. The method for determining which outside HVAC unit is connected to a selected inside HVAC unit as recited in claim 12, wherein said pulsed signal is created in said electrical pulse generator using an integrated circuit including a timer function.

19. The method for determining which outside HVAC unit is connected to a selected inside HVAC unit as recited in claim 13, wherein said pulsed signal is created in said electrical pulse generator using an electromechanical relay.

20. The method for determining which outside HVAC unit is connected to a selected inside HVAC unit as recited in claim 13, wherein said pulsed signal is created in said electrical pulse generator using an integrated circuit including a timer function.

* * * * *